US011247886B2

(12) United States Patent
Fritel et al.

(10) Patent No.: US 11,247,886 B2
(45) Date of Patent: Feb. 15, 2022

(54) PERSONNEL BASKET FOR OVERHEAD CRANES

(71) Applicant: Fritel & Associates, L.L.C., Waco, TX (US)

(72) Inventors: Raymond Fritel, Waco, TX (US); John Gibel, Waco, TX (US); Chase Sobala, Waco, TX (US)

( * ) Notice: Subject to any disclaimer, the term of this patent is extended or adjusted under 35 U.S.C. 154(b) by 338 days.

(21) Appl. No.: 16/245,178

(22) Filed: Jan. 10, 2019

(65) Prior Publication Data

US 2019/0210852 A1 Jul. 11, 2019

Related U.S. Application Data

(60) Provisional application No. 62/616,345, filed on Jan. 11, 2018.

(51) Int. Cl.
*B66F 11/04* (2006.01)
*B66F 17/00* (2006.01)

(52) U.S. Cl.
CPC ..... *B66F 11/044* (2013.01); *B66F 11/046* (2013.01); *B66F 17/006* (2013.01)

(58) Field of Classification Search
CPC ..... B66F 11/044; B66F 11/046; B66F 17/00; A47L 3/02
See application file for complete search history.

(56) References Cited

U.S. PATENT DOCUMENTS 2,998,094 A * 8/1961 Fisher ..... B66D 1/365 182/142
3,056,510 A 10/1962 Garnett
3,295,633 A * 1/1967 Milner, Jr. ..... B66F 11/046 182/222
4,185,716 A 1/1980 Rinehart
4,466,506 A * 8/1984 Dolenti ..... H02G 1/02 182/2.1
4,468,004 A 8/1984 Shaver et al.
4,518,059 A * 5/1985 Frey-Wigger ..... B66F 11/046 182/2.7
4,520,898 A * 6/1985 Allemane ..... E04G 5/14 182/113
4,650,036 A * 3/1987 Matsuda ..... B66B 9/00 182/142
4,660,678 A 4/1987 Krag
4,754,840 A * 7/1988 MacDonald ..... B66F 11/044 182/2.3
4,763,755 A * 8/1988 Murray ..... B66F 11/044 182/2.2
4,784,278 A * 11/1988 Luscombe ..... B66F 11/044 182/2.11
4,838,381 A * 6/1989 Michaud ..... B66F 11/044 182/2.3
4,884,454 A 12/1989 Johnson
4,962,827 A 10/1990 Garnett
(Continued)

*Primary Examiner* — Alvin C Chin-Shue
*Assistant Examiner* — Shiref M Mekhaeil
(74) *Attorney, Agent, or Firm* — John A. Powell

(57) ABSTRACT

A personnel basket that provides a partially enclosed work platform that may be readily attached or detached from the end of a crane boom and may be maintained level with the ground when suspended from a crane boom above ground and that is also capable of being collapsed from a work ready position into a stowed position of substantially smaller spatial volume when not in use.

11 Claims, 14 Drawing Sheets

(56) References Cited

U.S. PATENT DOCUMENTS

| | | | | | |
|---|---|---|---|---|---|
| 4,987,971 | A * | 1/1991 | Hedstrom | E04G 3/30 | 182/142 |
| 5,286,159 | A | 2/1994 | Honma | | |
| 5,381,872 | A | 1/1995 | Peruzzi et al. | | |
| 5,727,645 | A * | 3/1998 | Woodling | B66F 11/046 | 182/2.1 |
| 6,145,619 | A * | 11/2000 | Risser | B66F 11/044 | 182/113 |
| 8,418,810 | B2 * | 4/2013 | Barr | E04G 3/30 | 182/150 |
| 9,162,861 | B1 * | 10/2015 | Craig | B66F 17/006 | |
| 9,206,020 | B2 * | 12/2015 | Waisanen | B66C 17/00 | |
| 10,099,909 | B2 | 10/2018 | Steedley | | |
| 10,611,616 | B2 * | 4/2020 | Miles | B66F 11/044 | |
| 11,104,559 | B2 * | 8/2021 | Phillips | B66F 11/044 | |
| 2009/0096231 | A1 * | 4/2009 | Burlingame | B66F 11/04 | 294/68.3 |
| 2013/0048425 | A1 * | 2/2013 | Thompson | B66F 11/046 | 182/46 |
| 2013/0068558 | A1 * | 3/2013 | Schneider | B66F 11/046 | 182/63.1 |
| 2016/0257543 | A1 * | 9/2016 | Hufnagl | B66F 11/044 | |
| 2018/0370781 | A1 * | 12/2018 | Phillips | B66F 11/044 | |
| 2020/0335959 | A1 * | 10/2020 | Gibel | B65D 90/16 | |

* cited by examiner

PERSONNEL BASKET FOR OVERHEAD CRANES

PRIORITY CLAIM

This application claims priority to U.S. Provisional Application No. 62/616,345, filed on Jan. 11, 2018, which is hereby incorporated by reference.

FIELD OF THE INVENTION

The present invention is generally directed to personnel baskets (sometimes formerly called "manbaskets") that are enclosed or partially enclosed work platforms that can be supported and elevated by overhead cranes car attached to aerial lifts for the purpose of performing work at an elevated height above the ground.

BACKGROUND ART THE INVENTION

Personnel baskets encompass various types of industrial, elevatable work platforms that be attached to the boom of a crane or attached to an aerial lift and then raised above the ground to do work overhead. Personnel baskets come in many different forms, including simple aerial buckets, rigid metal cages, enclosed cabins, partially enclosed work platforms with hand railings and guards, and the like. Such personnel baskets may be attached to the end of a crane's boom or to an aerial lift which is then used to elevate the personnel basket and any personnel and equipment located therein to high, other wise inaccessible positions above the ground where work is to be performed by the personnel.

Personnel baskets are frequently used to perform work on, or to service, "hot" electric transmissions lines (power lines) that are suspended at a height by transmission poles and are energized at very high voltages. For these types of applications, a personnel basket will normally be attached to the end of a crane's boom, and the crane itself will normally be mounted on a mobile vehicle which is normally a service track, but could also be a continuous track vehicle or a rail mounted vehicle. In order to perform work on power lines, the crane and the personnel basket are transported by the mobile vehicle to the work site where work is to be performed, personnel will enter the personnel basket with their tools and equipment, and the crane will be used to elevate the personnel basket up to the level of the power lines and hold the personnel basket in an elevated, suspended position se that the personnel in the personnel basket can perform the necessary work on the power lines. Typically the crane's boom member, or a distal portion of the boom member, to which the personnel basket is attached, will be comprised of a highly electrically insulating material in order to prevent any discharge of current from the energized power lines through the personnel basket or through the personnel or equipment suspended at a height within the personnel basket.

For the type of power line applications described above, and for other similar applications in which work must be performed at a height above ground by personnel who will be suspended within an elevated personnel basket, the personnel baskets are sometimes permanently attached to the boom of a crane. When the overhead is completed and it becomes necessary to move the mobile vehicle from the work site, the personnel basket is normally lowered down by operation of the crane to approximately the level of the mobile vehicle, but the personnel basket may remain permanently attached to the crane that is mounted on the mobile vehicle. The personnel basket may be lowered onto the back of the mobile vehicle, where it will take up room that could otherwise be used for storing equipment, tools, and parts. The mobile vehicle will then transport the crane and the attached personnel basket to the next worksite without removing the personnel basket. However, this type of permanent or quasi-permanent attachment of the personnel basket to the crane's boom may prevent the crane and mobile vehicle on which at is mounted from being used for other applications that do not call for the elevation and suspension of a personnel basket. Thus, in some cases the personnel basket may be detached from the crane boom when it is stored on the back of a mobile vehicle for transport.

Furthermore, many personnel baskets are enclosed, or partially enclosed, work platforms with a generally open cuboidal structure comprised of a floor and walls that define a workspace. These types of personnel baskets typically have rigid structures comprised of frigidly connected members such as integral walls, floor, rails, guards or other similar incorporated features that are intended to prevent personnel from falling off the work platform or out of the work space provided by the personnel basket during work. As a result, most personnel baskets are bulky, cumbersome, and of capable of easy storage and transport. Some representative prior art devices include those disclosed in U.S. Pat. Nos. 3,056,510, 4,468,004, 5,286,159, 6,145,619, and 9,206,020. Although some of these prior art devices claim to be partially foldable or collapsible, none of them is actually easily collapsed or folded into a significantly smaller size that may be easily stored and transported. This creates difficulties in the context of using the prior art devices in connection with a service truck because space on the back of service trucks is almost always a commodity, and there is frequently very limited room for storage of tools, equipment, and parts. Moreover, it does not appear that the prior art devices could normally be removed from the end of a crane's boom or other similar elevating device for storage or transport purposes in a time-efficient manner, with most such removals of prior art devices taking over an hour to complete.

Another goal with personnel baskets of the type that are suspended from the end of a crane boom is to maintain such personnel baskets such that their floors and the work platforms they provide are generally level to the ground below. This is necessary because the power lines and other structures that workers will perform work on above ground are more or less level with the ground below. The workers situated on the work platform and in the workspace provided by the personnel baskets need a floor and work platform that provides them proper personal orientation in relation to the work object, such as power lines, and maintaining floor and work platform of the personnel basket in a level orientation to the ground while suspended from a carne boom is desirable.

SUMMARY OF THE INVENTION

The invention hereby disclosed is a foldable and stowable personnel basket that is intended to be detachably mounted to the end of a crane boom or other elevating device for elevation to a height where work is to be performed by one or more workers situated inside the personnel basket in a position that is maintained level to the ground below. The personnel basket disclosed herein is well-suited for quick, detachable connection to elevating devices mounted on mobile vehicles, such as the boom of a crane that is mounted on a service truck. The personnel basket hereby disclosed is capable of being detachably connected to the end of a crane boom so that it is suspended therefrom and yet also maintained at a selected angle in relation to the crane boom by means of an articulation plate and locking handle assembly. The personnel basket may also be quickly detached, collapsed and folded into a significantly smaller size when it is not in use and stored on the back of a mobile vehicle in a space-saving manner. The ability to quickly attach or detach the personnel basket from the end of a crane boom when the personnel basket is not in use is also facilitated by use of a quick attach assembly that involves connection of a quick attach yoke to the personnel basket and connection of a basket adapter component to the end of a crane boom.

When the personnel basket is to be used, it is placed in a work ready position such that its walls and its floor are fully extended and unfolded by means of a multiplicity of hinges, with the floor and three walls of the personnel basket capable of being locked in place using certain rigid connection members, and with one additional wall being comprised of two doors that may be opened for ingress or egress or that also be locked in a closed position when the doors are not to be opened, such as during use of the personnel basket at a height above the around. When the personnel basket is in the work ready position, it forms a partially enclosed, open cuboid structure with a floor that serves as a work platform and the floor and four vertical walls serving as a partially enclosed workspace within which one or more workers may stand on the floor of the personnel basket and be elevated above ground in the personnel basket by means of an attached crane boom to a height where work is to be performed. While in use, the worker(s) who are positioned inside the personnel basket and suspended with the personnel basket above ground by means of the crane boom or aerial lift may perform a wide variety of work, such as servicing of electric transmission lines, building repair, roof repair, etc. Further, while the personnel basket is in use, it may be maintained in a level position with respect to the ground below by means of the articulation plate and locking handle assembly which allows for the work platform and workspace to be lucked into a chosen angular relation with respect to the crane boom and thereby allows for the work platform provided to be maintained level with the ground below.

When the personnel basket hereby disclosed is no longer needed for use in performing work at a height above ground, it can be lowered to ground level and optionally be quickly detached from the elevating device following use within a matter of two to three minutes, or the personnel basket may be left attached to the crane boom. Whether the personnel basket is detached from the elevating device or remains attached, it may then be collapsed and folded into a stowed position for easy stowage and transport by means of detaching the various rigid connection members and folding the floor upwards and then folding the walls together by means of the multiplicity of hinges. When the personnel basket is in the stowed position, it may be stored on the back of a mobile vehicle for transport to another location on the mobile vehicle, or if it is detached from the elevating device it may be easily stored in a storage location until later use. As can be understood, the folding and stowing process may be reversed and the personnel basket may be quickly expanded and unfolded from the stowed position into its work ready position and then mounted on the end of a crane boom for use at any time that it is needed for work at a height above ground, preferably by means of the quick attach assembly. Thus, in an ideal embodiment, the personnel basket hereby disclosed may be selectively collapsed and folded for stowage and transport on the back of a service truck or expanded to its work ready position and quickly mounted to the end of a truck-mounted overhead crane's boom or other elevation device for elevation to a height where work is to be performed by personnel that are situated in the personnel basket.

It is an object of the present invention to provide a personnel basket that can be maintained at a specifically desired angle in relation to a crane boom to which the personnel basket is attached so as to ensure that the work platform provided by the personnel basket is level with ground when it is in use at an elevated height above ground.

It is further object of the present invention to provide a personnel basket that may be collapsed and folded into a stowed position for easy storage and transport on the back of a mobile vehicle such as a service truck when the personnel basket is not in use. The personnel basket in its stowed position is significantly more compact and occupies a significantly reduced volume as compared to the same personnel basket in its work ready position.

It is a further object of the present invention to provide a personnel basket that may be readily attached or readily detached from an elevating device such as a crane boom by means of a quick attach/quick detach assembly.

The embodiments and other features, aspects, and advantages of the present invention may be best understood and appreciated with reference to the following drawings, descriptions, and claims. Where used in the various figures of the drawings, the same numerals designate the same or similar parts. Furthermore, when the terms "top", "bottom", "front", "back", "vertical", "horizontal", "first", "second", "third", "inside", "internal", "outside", "external", "end", "ends", "side", "sides", "edge", "edges", and similar terms are used herein, it should be understood that these terms have reference only to the structure shown in the drawings as it would appear to a person viewing the drawings, and such terms are utilized in order to facilitate describing the invention and in order to facilitate a better understanding of the invention.

DETAILED DESCRIPTION OF CERTAIN PREFER ED EMBODIMENTS

Figure 1:
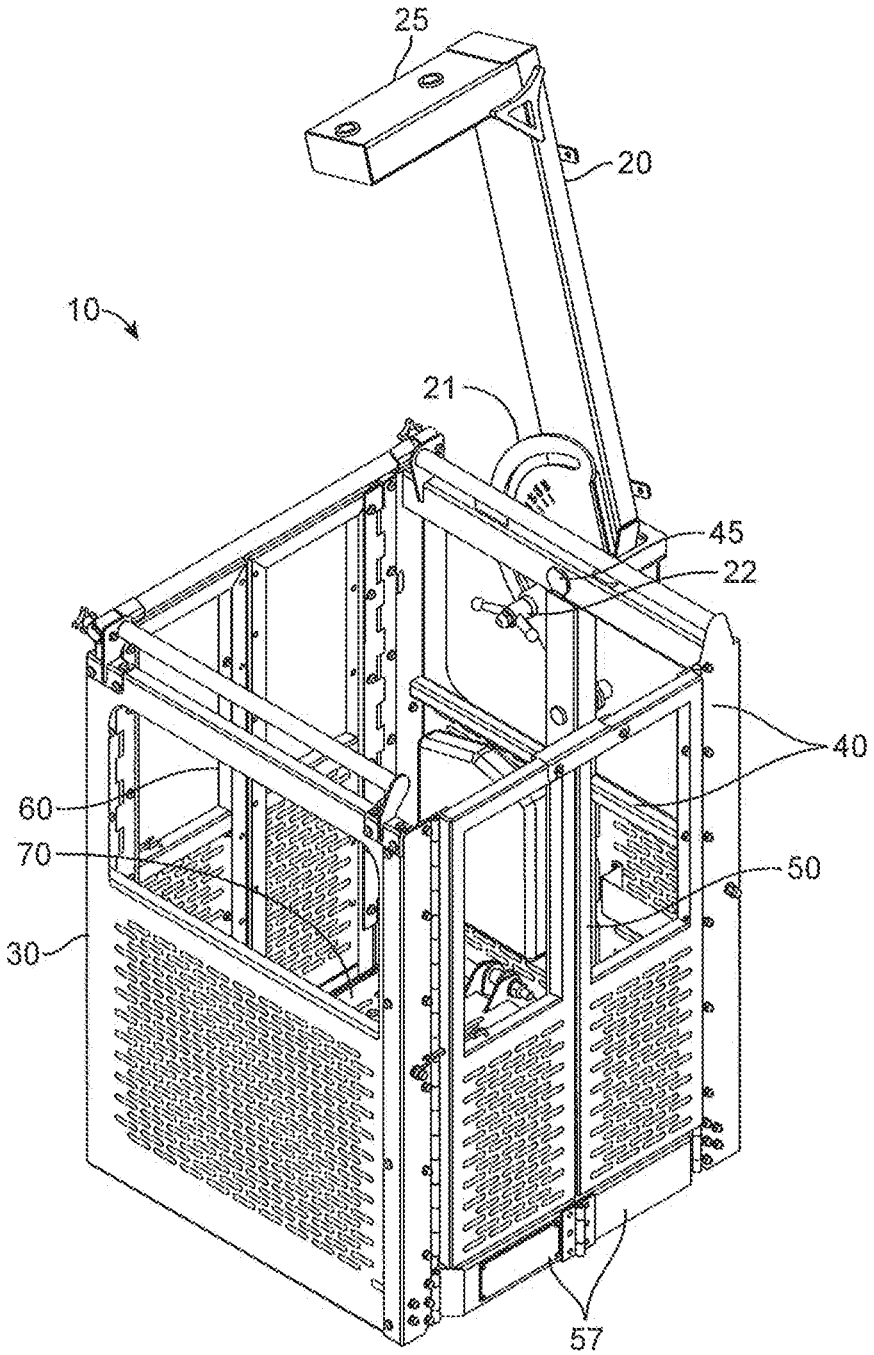
FIG. 1 shows a perspective view of the personnel basket.

FIGS. 1-6 show a personnel basket 10 according to the present invention in its fully extended and fully unfolded work ready position. The personnel basket 10 is comprised a basket yoke 20 that features an adapter mount 25 that selves as a means for attachment of the personnel basket 10 to the end of a crane boom or other elevating equipment that may be used to elevate the personnel basket 10 to a height above ground were work is to be performed. The basket yoke 20 serves as the main structural support for the personnel basket 10 when it is lifted and suspended above ground by a crane boom or other similar elevating equipment. The personnel basket 10 provides a workspace that is defined by four walls, namely, a back panel 30, a front panel 40, a door panel 50, and a collapsible side panel 60, and the workspace is also defined by a floor 70 that is positioned below the four walls and that serves as a work platform. The personnel basket 10 further comprises a vertical support beam 41 that is rigidly affixed to the vertical center of the front panel 40 such as by welding, bolts, or other rigid affixation means. As shown in FIG. 1, the personnel basket also has kick plates 57 that underlie the door panel 50 when the personnel basket 10 is in its work ready position.

An index plate assembly 21 featuring an articulation opening 26 is rigidly affixed to the basket yoke 20 by means such as welding, bolts, or other rigid affixation means, and the index plate assembly 21 and its articulation opening 26 extend outwardly to one side of the basket yoke 20. The basket yoke 20 is rotatably connected to the front panel 40 and the vertical support beam 41 by means of a yoke pin 45 that passes through the basket yoke 20, front panel 40 and vertical support beam 41. The index plate assembly 21 has a locking handle 22 that is situated within the articulation opening 26 and can be used to lock the personnel basket 10 into a variety of angular orientations in relation to the longitudinal axis of the basket yoke 20 by swinging the basket yoke 20 upwards or downwards. This is an important feature because it makes it possible to maintain the floor 70 that serves as the work platform in a level orientation with respect to the ground below when the personnel basket 10 is in its work ready position and is elevated above the ground by a crane or similar elevating device.

Figure 2:
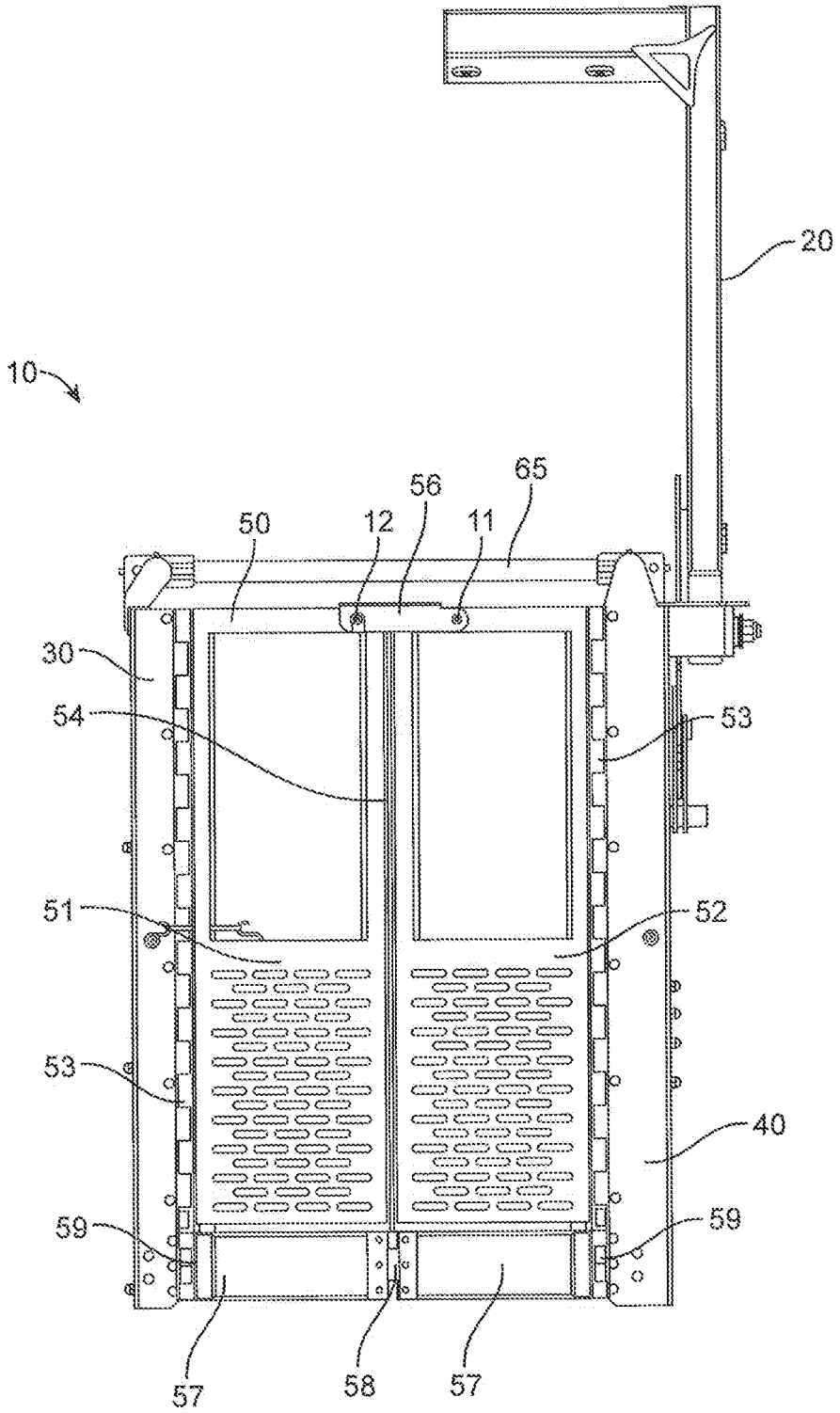
FIG. 2 shows a right side view of the personnel basket.

FIG. 2 is a right side view that shows the personnel basket 10 having a door panel 50 that is positioned intermediate of the back panel 30 and front panel 40. The door panel 50 is comprised of a first door 51 and a second door 52. The first door 51 and the second door 52 have inside vertical edges that are adjacent to one another at the door panel vertical center 54 when the personnel basket 10 is in is expanded work ready position and when the first door 51 and second door 52 are closed. While they are closed, the first door 51 and second door 52 may be locked in place with their inside vertical edges abutting each other at the door panel vertical center 54 by locking means. As illustrated in FIG. 2, such locking means may be comprised of a notched lock down plate 36 at the top of the door panel 50 that is pivotably attached to the top of one of the doors by pivoting attachment means, such as, for example, a pin connection 11, that allows for pivotable and detachable connection of the lock down plate 56 to lock connection means such as a notch pin 12. In this way the first door 51 and the second door 52 may be looked and held in a closed position when the notched lock down plate 56 is engaged with a notch pin 102.

The first door 51 is hingedly connected to the hack panel 30 and the second door 52 is hingedly connected to the front panel 40 by means of door piano hinges 53 that allow for the two doors to be opened inwardly into the workspace defined by the walls to a point where they are each parallel to the back panel 30 and front panel 40. When the personnel basket 10 is to be switched from its work ready position to its stowed position, the first door 51 and the second door 52 are unlocked from one another by detaching the notched lock down plate 56 from the notch pin 102, and pivoting the lock down plate 56 upwards and away from the top of the door panel 50 so that the first door 51 and second door 52 are free to be rotated up to 90 degrees inwardly on their respective door piano hinges 53 until they are, respectively, parallel with the back side panel 30 and the front main panel 40. In other words, the two doors 51, 52 of the door panel 50 are opened inwardly and will be swung inwardly by means of the door piano hinges 53 until they are parallel with each other and also with the back side panel 30 and the front main panel 40 when the personnel basket 10 is being collapsed into a stowed position.

As shown in FIG. 2, the personnel basket 10 is further comprised of two identical kick plates 57 that are positioned underneath the door panel 50 with one of the kick plates 57 being located below first door 51 and the other of the kick plates 57 being located below the second door 52. The two kick plates 57 are hingedly connected to each other by means of a center hinge 58 that is located at the door panel vertical center 54. Each of the kick plates 57 is also hingedly attached to a wall of the personnel basket 10 by means of standard hinges 59, with one kick plate 57 hingedly attached to the back panel 30, and the other kick plate 57 hingedly attached to the front panel 40. When the personnel basket 10 is in its work ready position as shown in FIGS. 1-6, and when the first door 51 and second door 52 are in a closed position, the kick plates 57 will underlie, and will be in parallel with, the door panel 50 as illustrated in FIG. 2. FIG. 2 also illustrates that the front panel 40 is attached to the basket yoke 20 that is the main structural element that will be used to support the personnel basket 10 on the end of a crane's boom.

Figure 3:
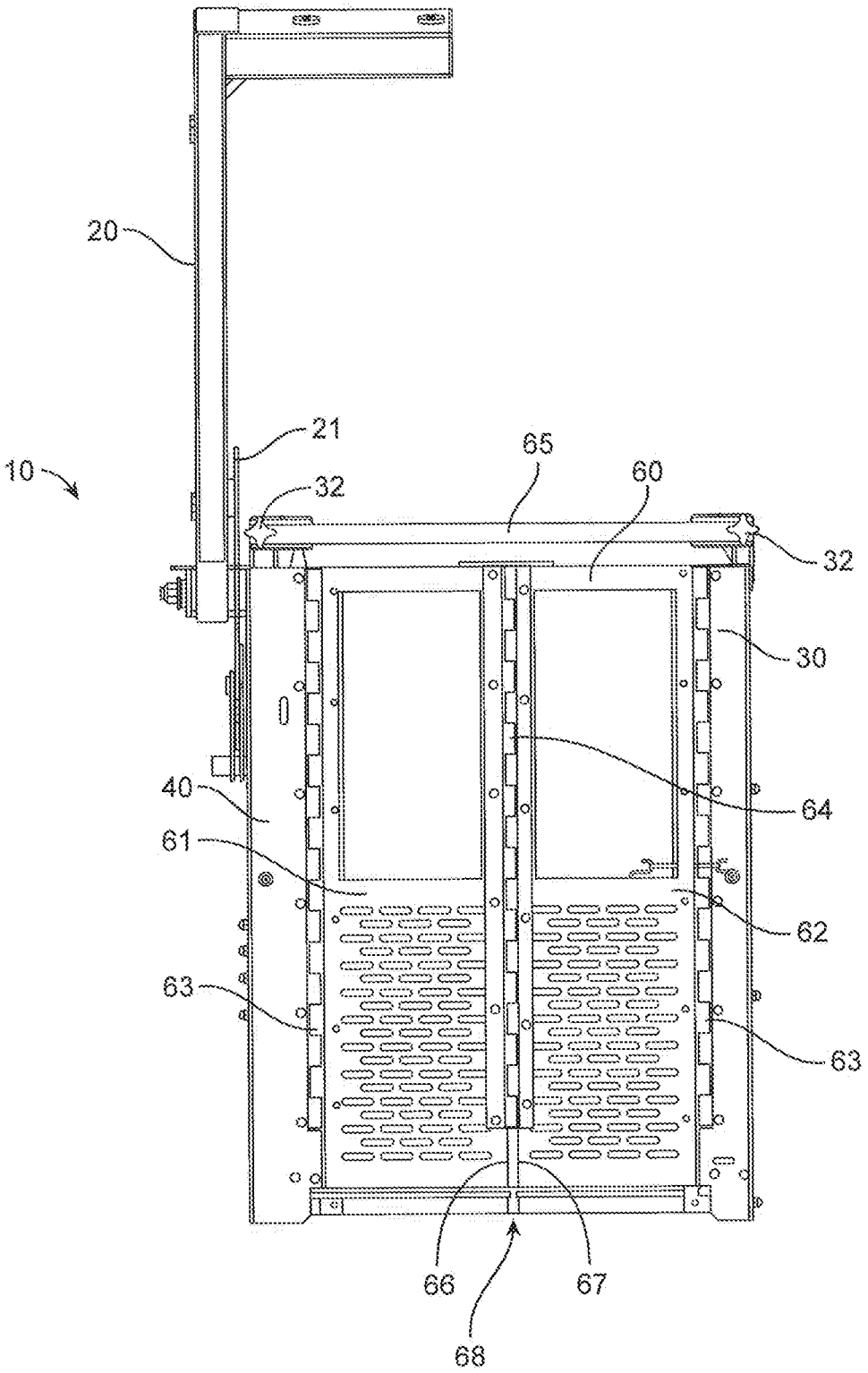
FIG. 3 shows a left side view of the personnel basket.

FIG. 3 is a left side view of the personnel basket 10 that shows the collapsible side panel 60 while the personnel basket is in its work ready position. It can be appreciated from viewing FIG. 3 that the collapsible side panel 60 is capable of being folded inwardly in an accordion-like manner when the personnel basket 10 is collapsed into its stowed position. The collapsible side panel 60 is comprised of a first folding panel 61 and a second folding panel 62 that are hingedly connected to each other at a side panel center 68 by means of a central hinge 64 that connects the central vertical edges 66, 67 of the respective folding panels 61, 62. The collapsible side panel 60 is positioned intermediate of the front panel 40 and the back panel 30, with side piano hinges 63 hingedly connecting the folding panels 61, 62 to the respective front panel 40 and back panel 30. When the personnel basket 10 is in its work ready position as illustrated in FIGS. 1-6, the folding panels 61, 62 cooperate to form a wall of the personnel basket 10, and their respective central vertical edges 66, 67 are abutment. When the personnel basket 10 is switched to its stowed position, the collapsible side panel 60 will be collapsed inwardly in accordion-like manner at the side panel center 6 by means of the central hinge 64 with the first folding panel 61 and the second folding panel 62 each being swung up to 90° inwardly by means of the central hinge 64 and the side piano hinges 63. When the personnel basket 10 is in its stowed position, the first folding panel 61 and second folding panel 62 will each be intermediate of, and parallel with, the front panel 40 and back panel 30.

As also illustrated in FIG. 3, when the personnel basket 10 is in its work ready position, a removable, rigid hand rail 65 that runs the length of the collapsible side panel 60 may be detachably connected to the personnel basket 10 so that it extends slightly inwardly from the top edge of the collapsible side panel 60. Detachable connection of the rigid hand rail 65 is accomplished by attachment means, such as, for example, threaded studs and forearm knobs 32 that serve as attachment means to detachably connect the rigid hand rail 65 on one of its ends to the front panel 40 and on its opposite end to the back panel 30. Attachment of the hand rail 6 in this manner serves, in part, to prevent the collapsible side panel 60 from collapsing inwardly when the personnel basket 10 is in its work ready position and is to be used. The handrail extends inwardly in relation to the top edge of the collapsible side panel 60 in order to comply with safety requirements. When if is desired to place the personnel basket 10 into its collapsed, stowed position, the removable hand rail 65 will be detached from the front panel 40 and from the back panel 30 by means of the threaded studs and forearm knobs 32 so that the collapsible side panel 60 can be folded inwardly in an accordion-like manner.

As can be appreciated from FIGS. 1-3 and the foregoing descriptions, the personnel basket 10 may be placed into its stowed position by collapsing the collapsible side panel 60 inwardly the same time that the doors 51, 52 are opened inwardly thereby collapsing the door panel 50 inwardly. The kick plates 57 are also folded inwardly by means of the center hinge 58 and the standard hinges 59 when the personnel basket 10 is placed into its stowed position. As this inward collapsing of the collapsible side panel 60 and the door panel 50 is accomplished, the entire personnel basket 10 may be collapsed and folded into a stowed position with compressive force being applied to the front panel 40 and the back panel 30 so that they are pushed/drawn towards each other and into close proximity with each other in accordion-like fashion.

Figure 4:
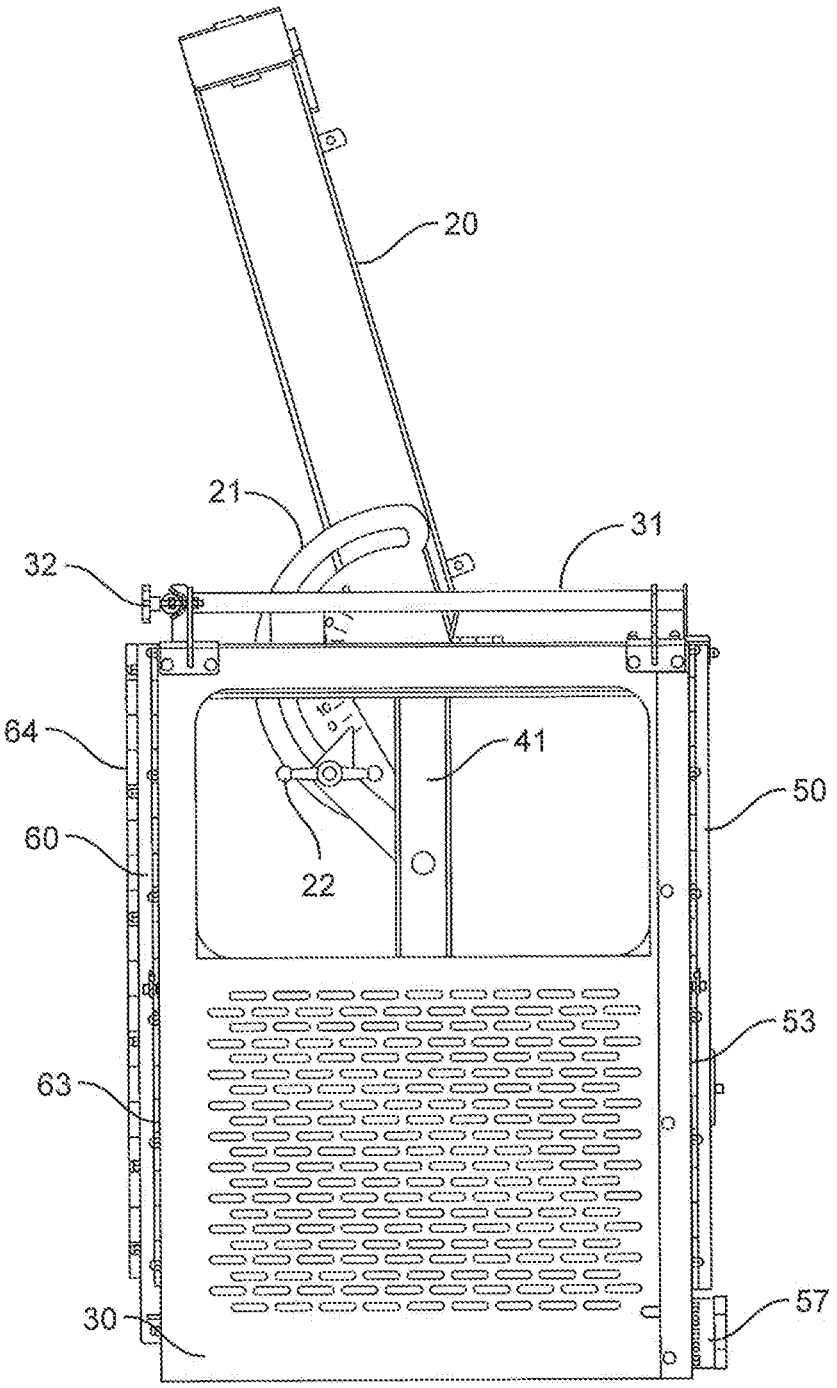
FIG. 4 shows back view of the personnel basket.

FIG. 4 is a back view of the personnel basket 10 in its work ready position. As shown in FIG. 4, the back panel 30 is a rigid, generally planar surface connected on one side to the door panel 50 by means of door piano hinges 53, and connected on its opposite side to the collapsible side panel 60 by means of side piano hinges 63. The back panel 30 may also feature a rigid back hand rail 31 that is rigidly affixed to the top edge of the back panel 30 and extends slightly inwardly above the workspace. As illustrated in FIG. 4, in a preferred embodiment the back panel 30 may have a of perforations through its surface in order to reduce the overall weight of the personnel basket 10 and increase aeration of the space contained within the partial cuboid structure of the personnel basket 10 when it is in its work ready position.

Figure 5:
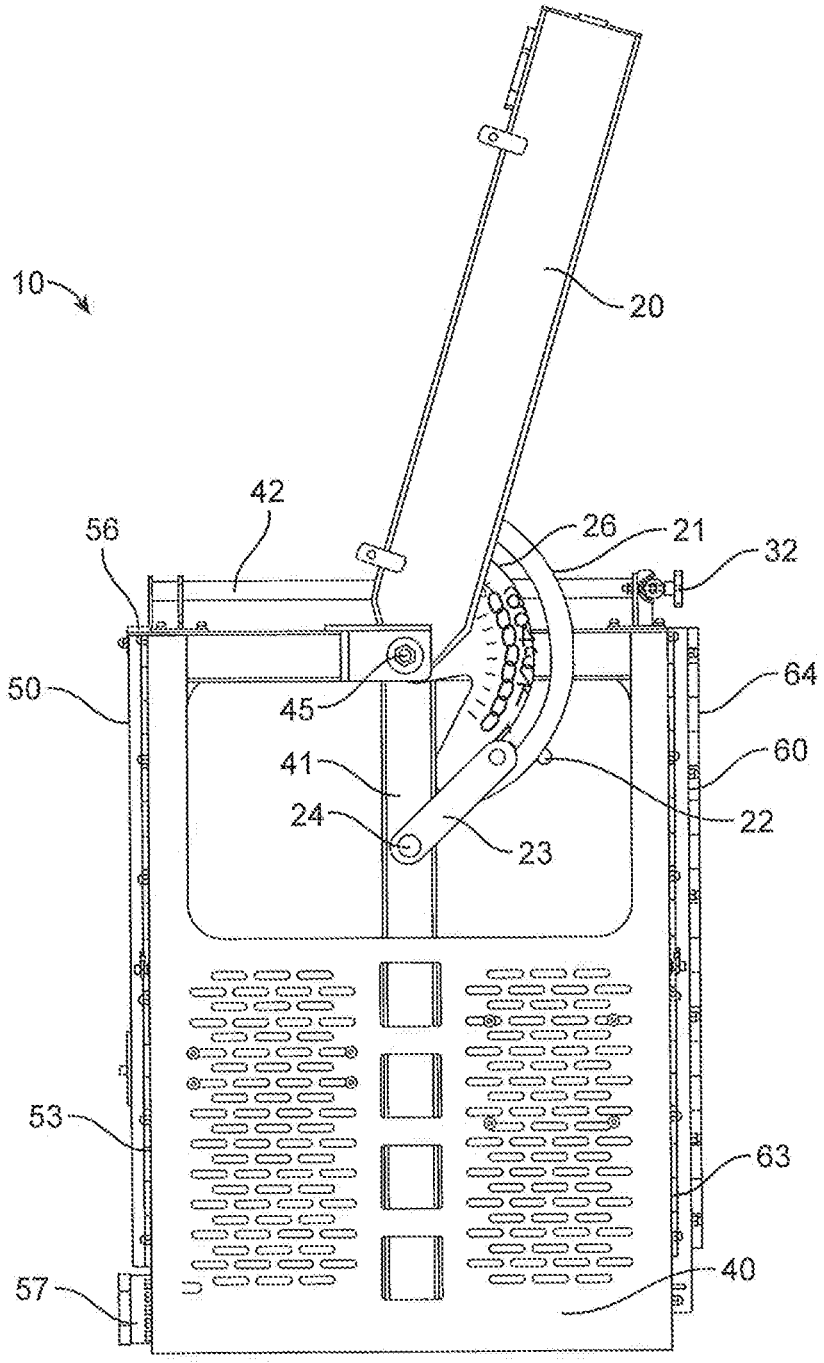
FIG. 5 shows a front view of the personnel basket.

FIG. 5 is a front view of the personnel basket 10 showing the front panel 40 and the vertical support beam 41 that is rigidly affixed to, or forms an integral part of, the front panel 40. The front panel 40 and the vertical support beam 41 are attached to the basket yoke 20 by means of a yoke pin 45. As previously discussed, the yoke pin 45 passes through the basket yoke 20 and also through the front panel 40 and the vertical support beam 41 that is rigidly affixed to the front panel 40. Then the locking handle 22 is not engaged and locked into a set position within the articulation opening 26, the basket yoke 20 may be swung up or down in relation to the front panel 40 and vertical support beam 41 by means of the yoke pin 45. Likewise, the front panel 40 and is affixed vertical support beam 41 are free to rotate around the yoke pin 45 until the basket yoke 20, front panel 40, and vertical support beam 41 are all locked into position in relation to each other by means of the index plate assembly 21 and engagement/locking of the locking handle 22 within the articulation opening 26. As shown FIG. 5, the index plate assembly 21 provides the articulation opening 26 through which the locking handle 22 passes and wherein the locking handle may be engaged and locked into various positions within the articulation opening 26. As illustrated, the locking handle 22 is also connected to a locking plate 23 that is further rotatably connected to the vertical support beam 41 by means of a pivot pin 24.

The main body of the personnel basket 10 providing a workspace consisting of the four walls 30, 40, 50, 60, floor 70, and vertical support beam 41, may be locked into position in relation to the basket yoke 20 by moving the locking handle 22 to the desired position within the articulation opening 26 and then locking the locking pin 22 in place so that the front panel 40 and its vertical support beam 41 are held in the desired position in relation to the basket yoke 20. As can be seen from FIG. 5, the front panel 40 is hingedly connected to the door panel 50 by means of door piano hinges 53 and is also hingedly connected to the collapsible side panel 60 by means of side piano hinges 63. A rigid front hand rail 42 rigidly affixed to the top edge of the front panel 40 and spans the length of the front panel 40. The front hand rail 42 is positioned so that it extends inwardly from the top edge of the front panel 40.

Figure 6:
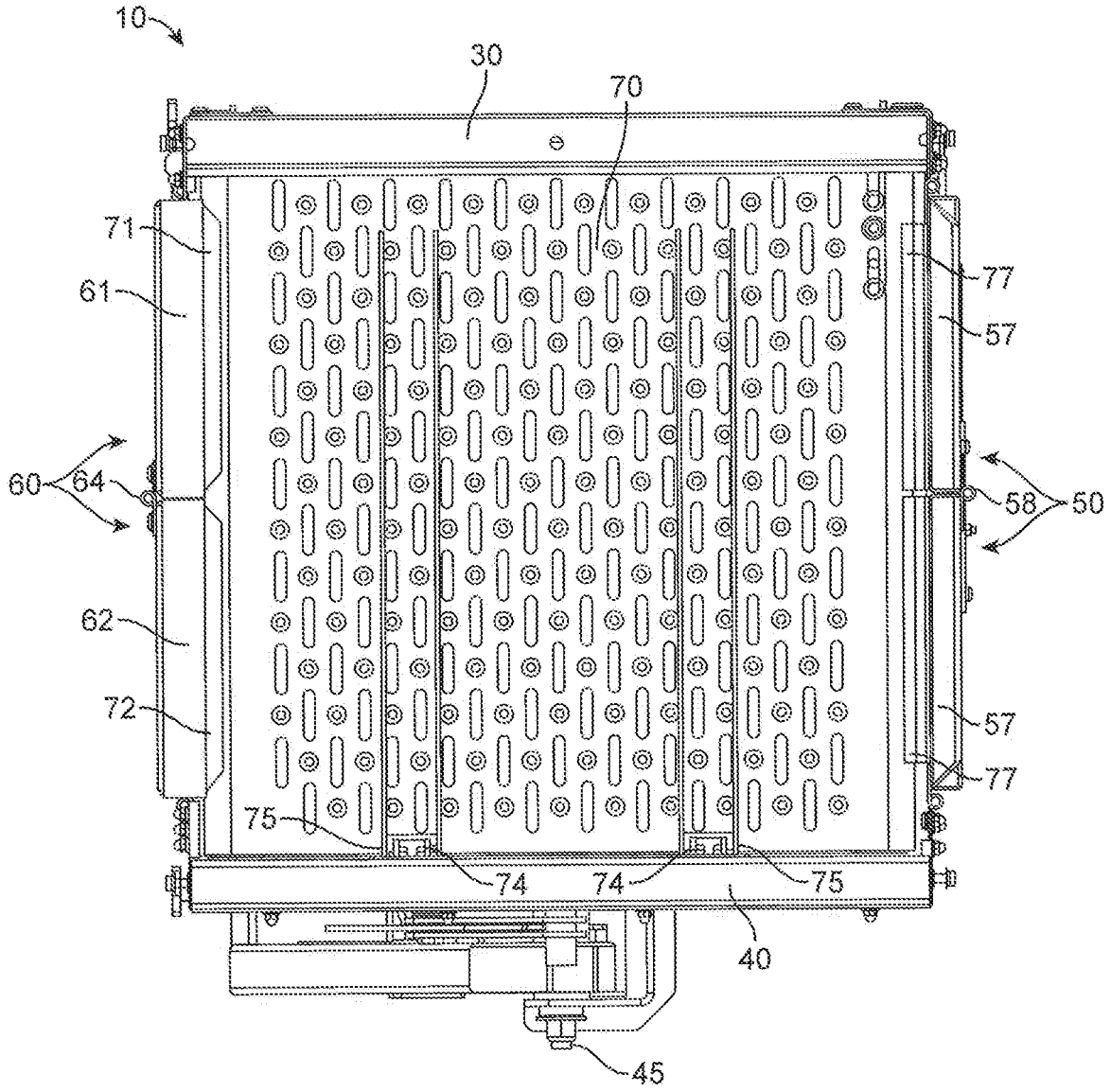
FIG. 6 shows a bottom view of the personnel basket.

FIG. 6 is a bottom view showing the floor 70 of the personnel basket 10. The floor 70 is rigidly affixed to at least one, and preferably two, floor support arms 75. The floor support arms 75 provide the main support for the floor 70 of the personnel basket 10 when it is in its work ready position, as illustrated in FIGS. 1-6. The floor support arms 75 are pivotably attached to the bottom edge of the front panel 40 pivot point affixations 74, for example, the pivot point affixations 74 may simply be bolts that pass through holes in the floor support arms 75 and also through anchor points on the bottom edge of the front panel 40. The importance of the pivot point affixations 74 is that they allow for the floor support arms 75 to be rotated upward so that the floor 70 can be moved to a position where it is intermediate of, and parallel to, the front panel 40 and the back panel 30 when the personnel basket 10 is collapsed into its stowed position. In other words, the floor support arms 75 may be pivoted upward by means or the pivot point affixations 74, thereby swinging the at shed floor 70 upwards by up to 90° when the personnel basket 10 is being switched into its stowed position. As illustrated, the ends of the floor support arms 75 abut the bottom edge of the front panel 40 when the personnel basket 10 is in a work ready position and the floor support arms 75 and floor 70 are in a horizontal position, thereby providing support to personnel that may be standing within the personnel basket 10 and preventing the floor 70 and floor support arms 75 from rotating downward.

As shown by FIG. 6, in a preferred embodiment the first folding panel 61 will have a first metal lip 71, and the second folding panel 6 will have a second metal lip 72, such that the two metal lips 71, 72 will underlie, and provide additional support to, the floor 70 when the personnel basket is in its work ready position and personnel are situated within the personnel basket 10. Likewise, in a preferred embodiment the two kick plates 57 will have kick plate lips 77 that will also underlie and provide support to the floor 70 when the personnel basket is in its work ready position. Together, the metal lips 71, 72 and kick plate lips 77 will cooperate with each other and with the floor support arms 75 to provide further structural support to the floor 70 on which personnel will stand when the personnel basket 10 is it its work ready position and work is being done at an elevated height above ground.

Figure 7:
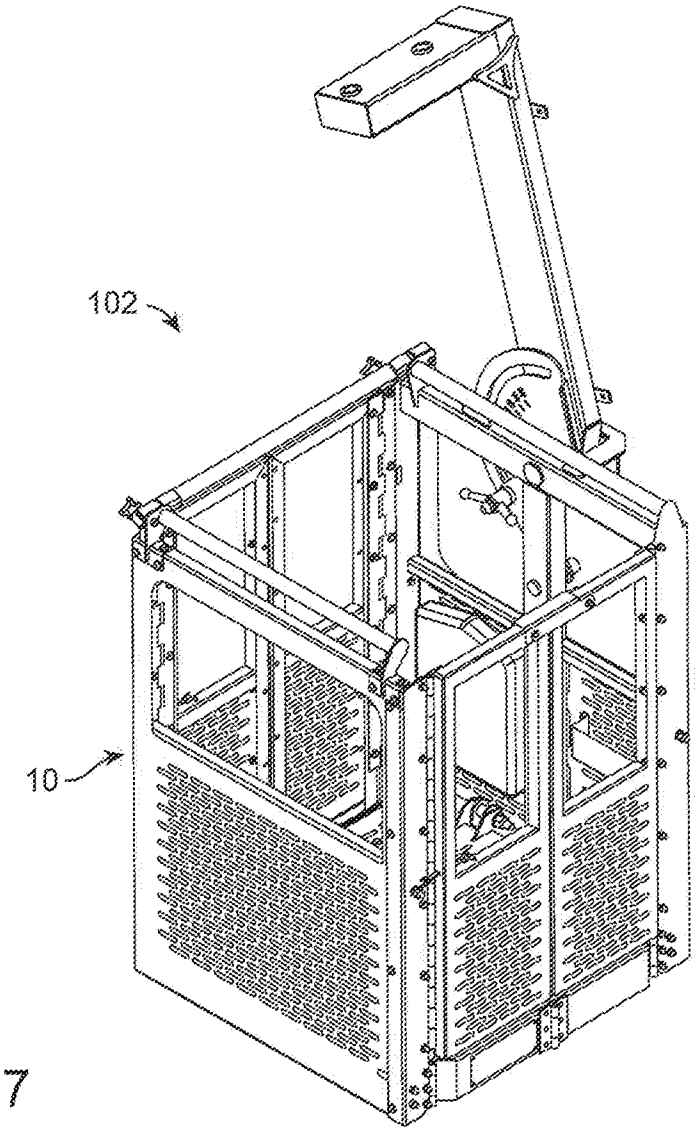
FIG. 7 shows a perspective view of the personnel basket in its two alternate configurations, which are the stowed position and the work ready position.
Figure 7:
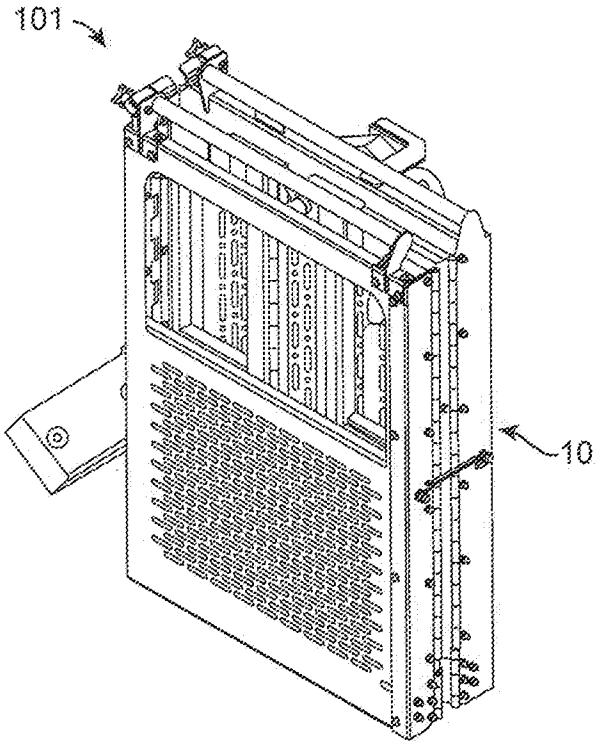

FIG. 7 is a perspective view that is intended to simply show the contrast between the personnel basket 10 in its two separate configurations, including its stowed position 101 and also its work ready position 101.

Figure 8:
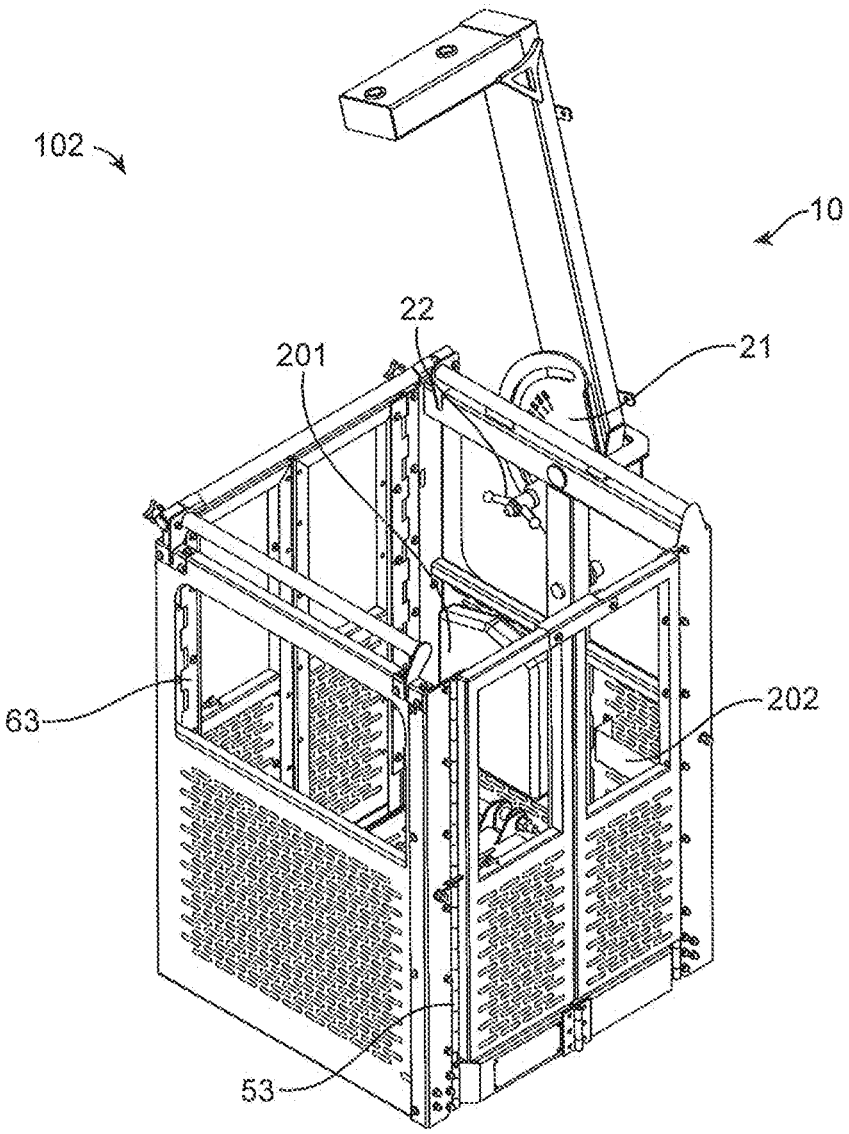
FIG. 8 shows a perspective of the personnel basket.

FIG. 8 is a perspective view of the personnel basket 10 in its work ready position 102. As previously described, the index plate 21 that is rigidly affixed to the basket yoke 20 and the locking handle 22 that passes through the articulation opening 26 allow for the personnel basket 10 to be kept level with the ground at different crane boom angles by adjusting the angle between the basket yoke 20 and the underlying workspace components of the personnel basket 10. Door piano hinges 53 and side piano binges 63 are again illustrated. Optional helpful equipment may also be installed or mounted on the personnel basket 10, such as a protective case for manuals 201 and a tool box 102.

Figure 9:
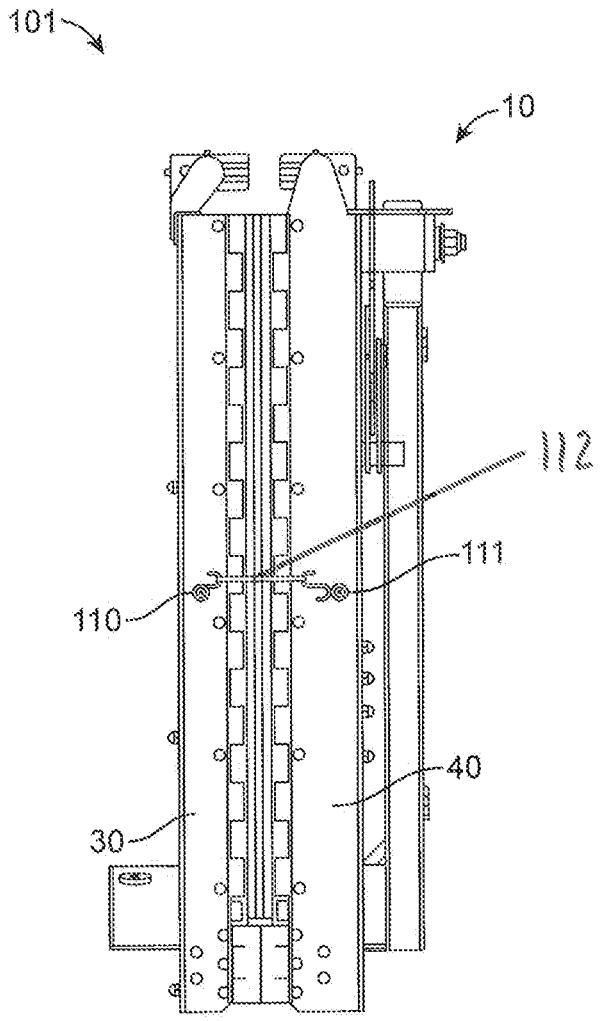
FIG. 9 shows a side view of the personnel basket in its stowed position.

FIG. 9 is a side view of the personnel basket 10 in the stowed position 101. As shown in FIG. 9, in a preferred embodiment the personnel basket 10 includes means for maintaining the personnel basket in the stowed position 101. For example, as shown in FIG. 9, a first hook 110 may be affixed to the back panel 30 and a second hook 111 may be affixed to the front panel such that when the personnel basket 10 is in the stowed position 101 an elastic band 112 may be used to connect the first hook 110 with the second hook 111 in order to maintain pressure bolding the personnel basket 10 in the stowed position 101. When the personnel basket 10 is desired to be placed into the work ready position 102, the elastic band 112 will simply be removed. In practice, many other types of means for maintaining the personnel basket 10 in a stowed position 101 might be used, for instance, a locking mechanism, a chain secured to bolts, a bolt with holes and cotter pins, a notch and pin type connection, a pin, chain, and hook arrangement, or even and loop type fastening system could be employed without departing from the inventive concept. Thus a ide variety of means may be employed for holding the personnel basket 10 in stowed position 101.

Figure 10:
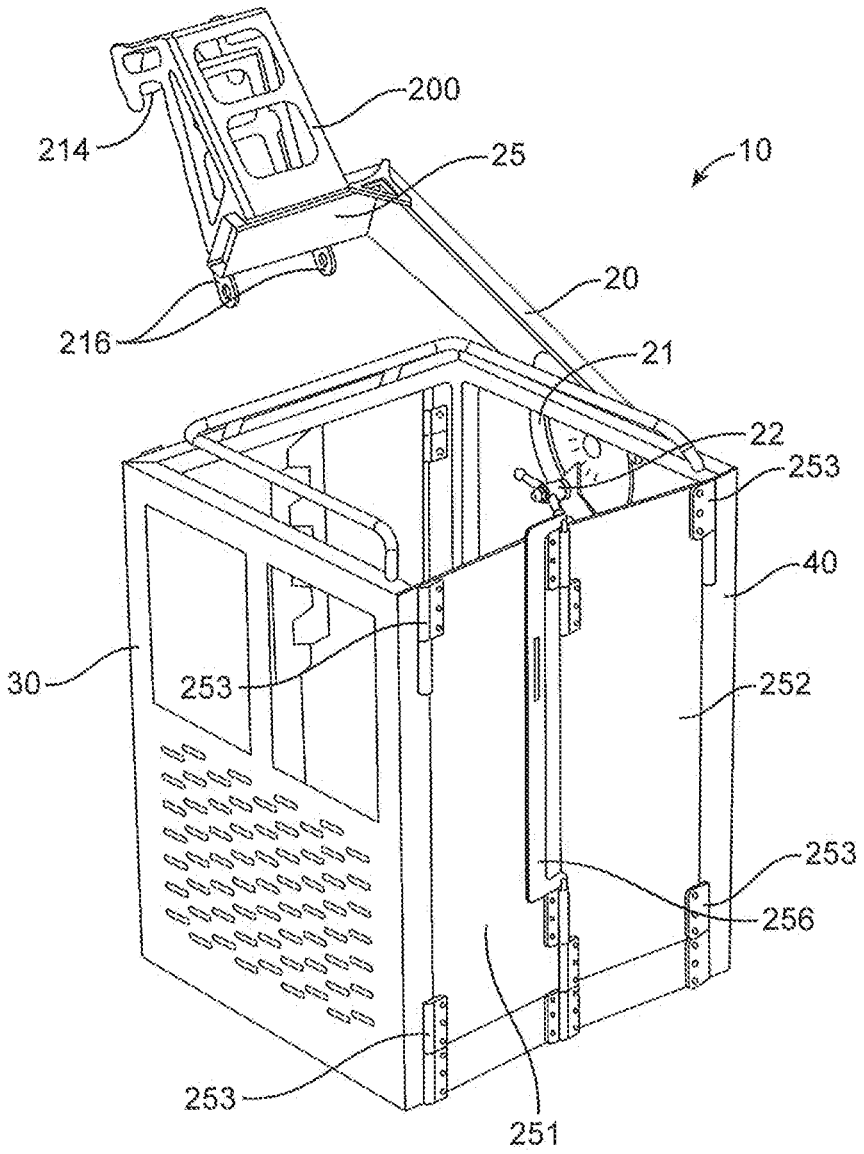
FIG. 10 shows a perspective view of a alternative embodiment of the personnel basket in its work ready position and demonstrates additional features of the invention.

FIG. 10 shows an alternative embodiment of the inventive concept. In FIG. 10, the personnel basket 10 includes some of the same features as those previously illustrated, such as a basket yoke 20, an index plate 21, a locking handle 22, as adapter mount 25, a back panel 30, and a front panel 40. However, the alternative embodiment of the personnel basket 10 is shown with an alternative first door 251 and an alternative second door 252 that are solid metal plates with no perforations wherein the alternative doors 251, 252 may be detachably connected to each other and locked in place at their central vertical edges such as with a door lock plate 256 as illustrated that is different from the previously described lock down plate 56. Further, the doors 251, 252 are illustrated as being hingedly connected to the respective back panel 30 and front panel 40 by multiple separate door hinges 253 rather than the single door piano hinges 53 previously described.

The most salient features that are illustrated by FIGS. 10-16 which were not shown in FIGS. 1-9 are an optional quick attach yoke 200 and an optional basket adapter 300. The quick attach yoke 200 optionally may be either permanently affixed to, or detachably connected to, the adapter mount 25 of the personnel basket 10 by means such as bolts, pins, screws, welds, rivets, or other similar means. The quick attach yoke 200 is comprised of a U-channel receiver 214 and two bolt holes 216. The basket adapter 300 optionally may be permanently affixed to, or detachably connected to, the end of a crane boom 501 of a mobile vehicle 500 (neither the crane boom 501 nor the mobile vehicle 500 are part of the invention) in a similar manner. The basket adapter 300 is comprised of an adapter jaw 314 and an adapter bolt 316.

In practice, when it is desired to connect a personnel basket 10 to the end of a crane boom 501, attachment and use of the quick attach yoke 200 with the personnel basket 10, along with connection of the basket adapter 300 to the end of the crane boom 501, facilitates the rapid, efficient attachment or detachment of the personnel basket 10 to/from the crane boom 501. To attach the personnel basket 10 to the end of a crane boom, the adapter jaw 314 of the basket adapter 300 is inserted into the U-channel receiver 214 of the quick attach yoke 200, and the adapter bolt 316 slides through the two bolt holes 216 and is pinned in place on either side of the quick attach yoke 200, for example with cotter pins, bolts, screws or similar detachable connection means (not illustrated). In this manner, the personnel basket 10 may be quickly attached to a crane boom 501. The attachment process may be reversed in order to quickly detach the personnel basket 10 from the end of the crane boom 501.

Figure 11:
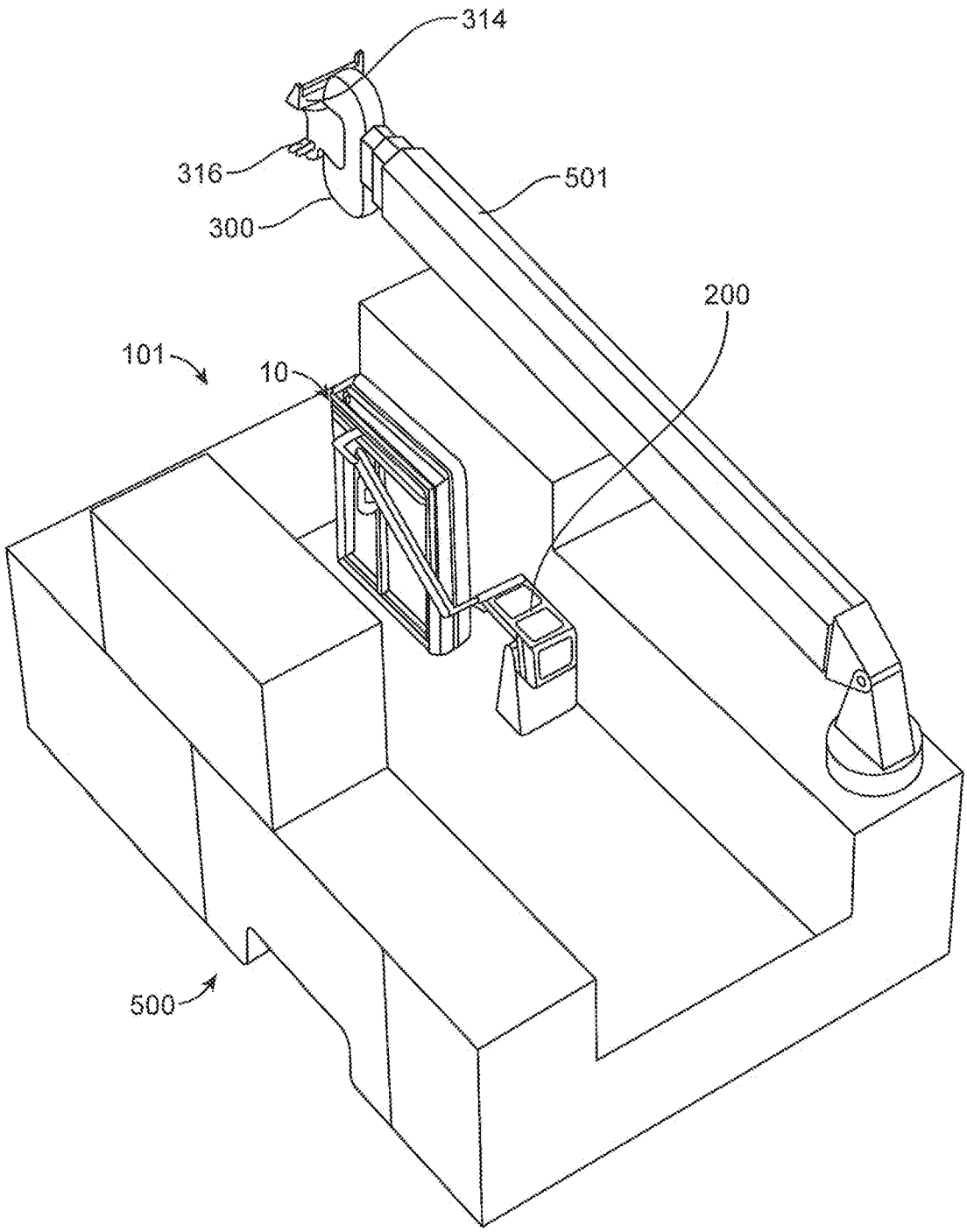
FIG. 11 shows a perspective view of the personnel basket in its stowed position detached from a crane boom and stored on the back of a mobile vehicle.
Figure 12:
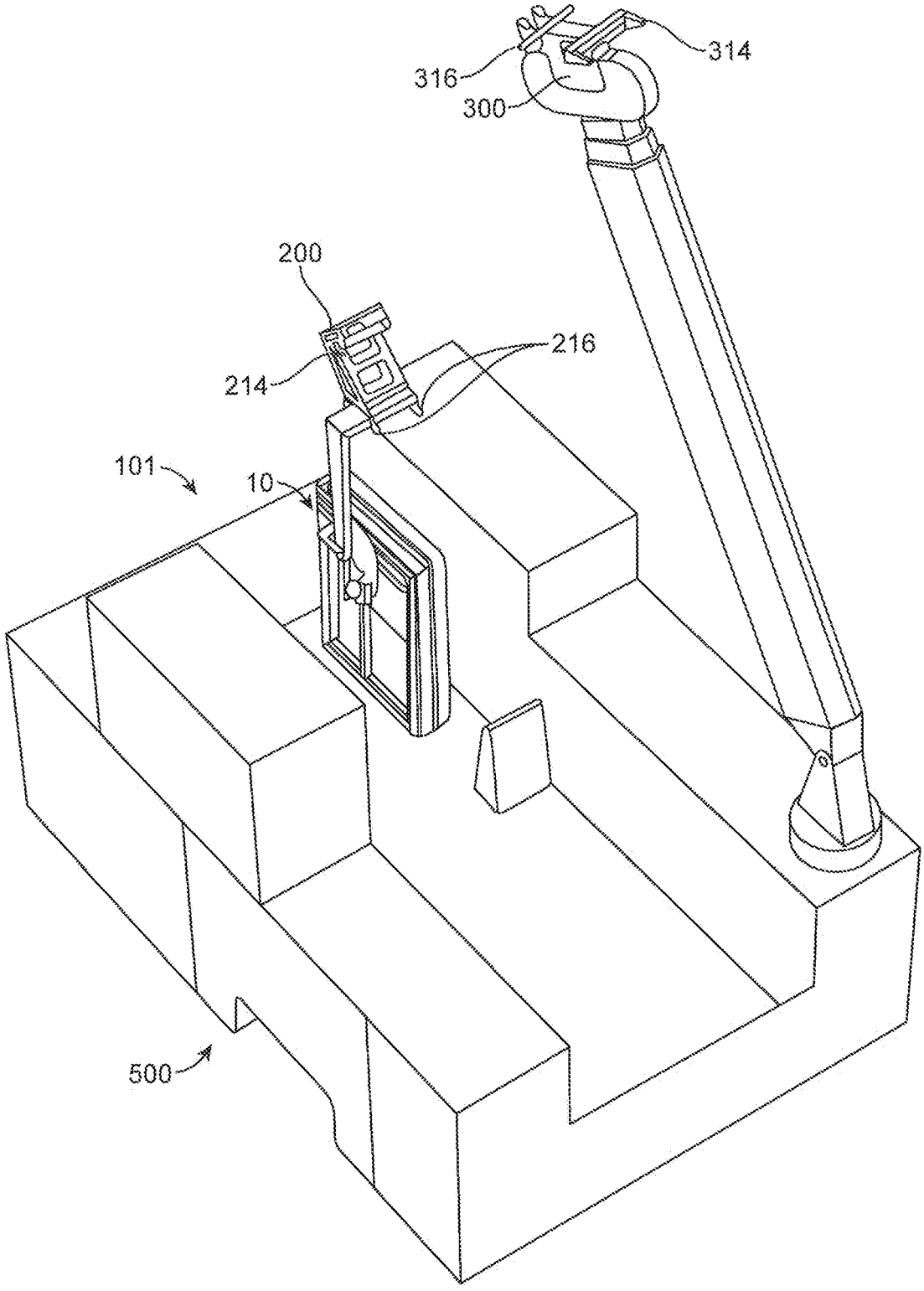
FIG. 12 shows an alternate perspective view of the personnel basket in its stowed position detached from a crane boom and stored on the back of a mobile vehicle.
Figure 13:
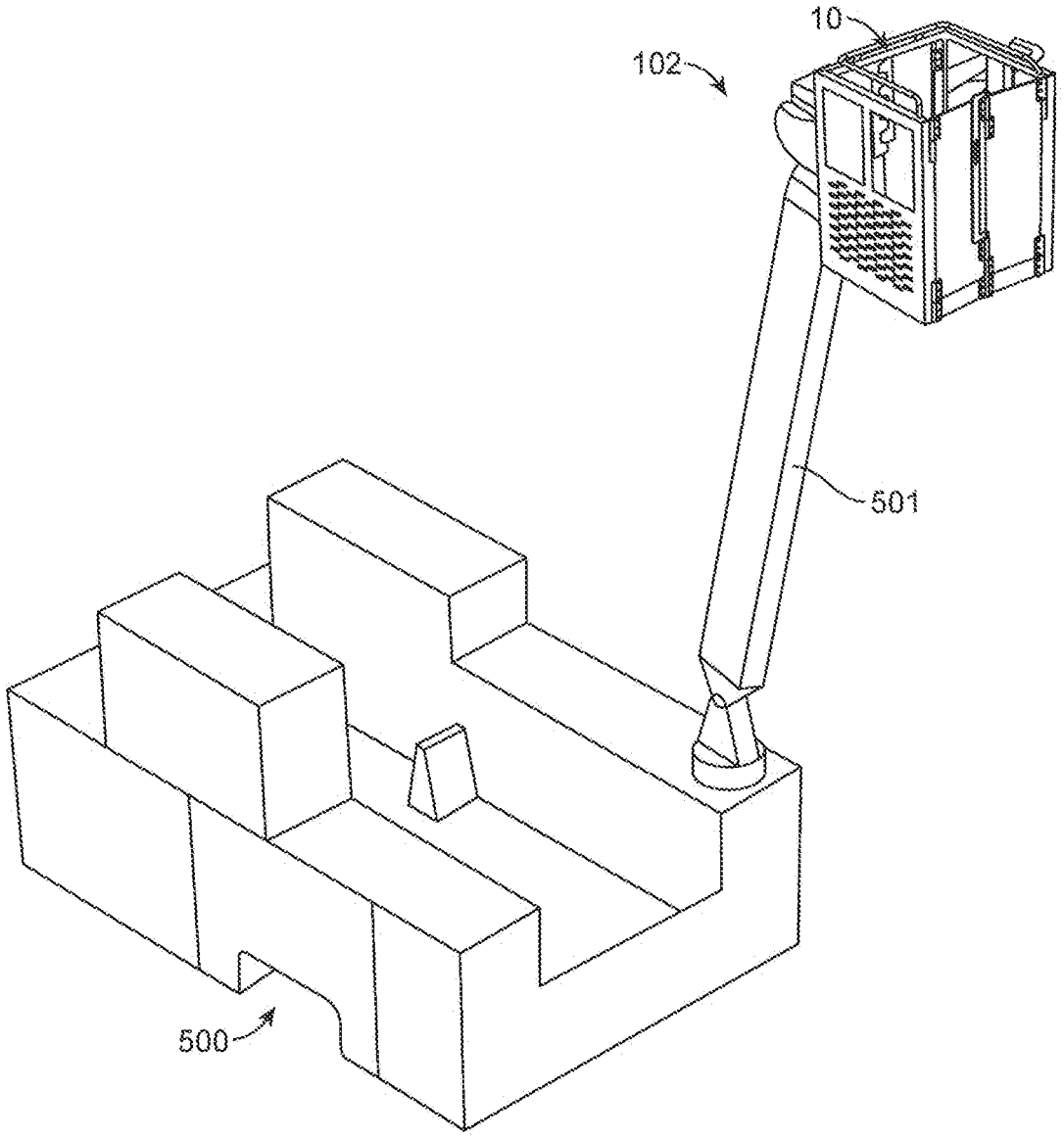
FIG. 13 shows a perspective view of the personnel basket in a work ready position and elevated to a height by an attached crane boom of a mobile vehicle.

FIGS. 11-12 illustrate the personnel basket 10 in a stowed position 101 on the back of a mobile vehicle 500. FIG. 13 shows the personnel basket 10 in a work ready position 102 and elevated above ground by a crane boom 501 that is attached to a mobile vehicle 500.

Figure 14:
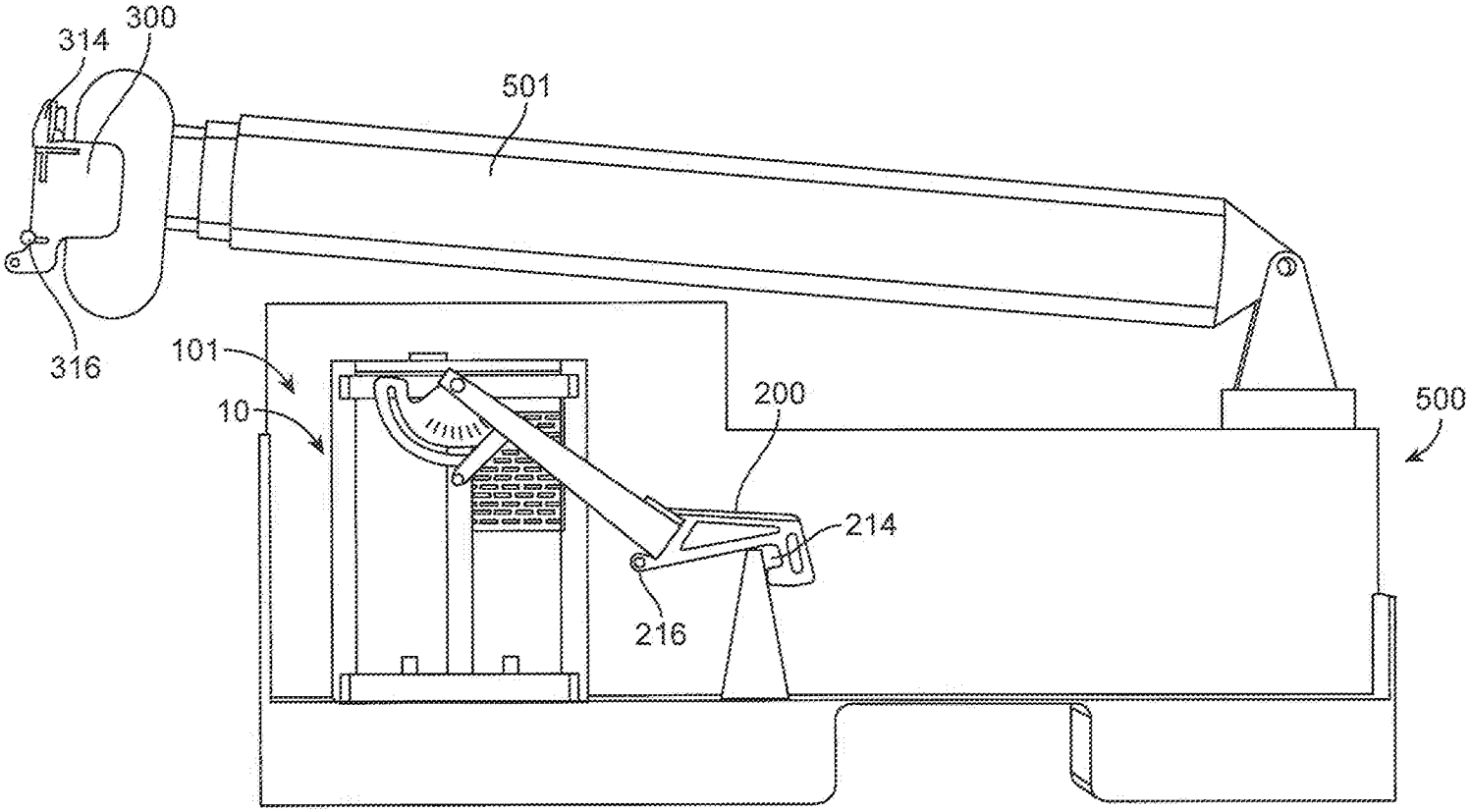
FIG. 14 shows a side view of a mobile vehicle and crane boom (neither of which are part of the invention) and a front view of the personnel basket in a stowed position on the back of the mobile vehicle.

FIG. 14 shows the personnel basket 10 in a stowed position 101 on the back of a mobile vehicle 500. The optional quick attach yoke 200 with its U-Channel receiver 214 and bolt holes 216 are again illustrated as attached to the personnel basket 10. The optional basket adapter 300 with its adapter jaw 314 and adapter bolt 316 are also again illustrated as being attached to the end of the crane boom 501.

A few other observations regarding the disclosed personnel basket should be set forth. The two doors of the door panel, the two folding panels of the collapsible side panel, the front panel, the back panel, and the floor panel have all been illustrated as having multiple small holes located at regular intervals through their main surfaces. As illustrated in FIG. 10 with regard to the doors of the alternate embodiment of the personnel basket, such holes are optional and are not required to practice the invention, and all of the walls and floor may optionally be made of solid metal. However, the multiplicity of small holes in the panels and floor are generally preferred because they reduce the overall weight of the personnel basket without compromising its mechanical integrity since the panels and floor are all made of metal. Furthermore, the presence of multiple holes allow for increased aeration and ventilation within the workspace for the benefit of the worker(s) located within the personnel basket.

In practice, the personnel basket has great utility because of the combination of its ability to be suspended from a crane boom and maintained level with the ground below when the personnel basket is in work ready position and being used, along with its ability to be collapsed and folded into a much smaller stowed position that can be easily stowed on the back of a mobile vehicle such as a service truck when the personnel basket is not in use. The personnel basket hereby disclosed, is capable of being collapsed into a stowed position that occupies from 35% to 50% of the total spatial volume as the personnel basket in its work ready position. Prototypes of the personnel basket designed for single occupancy in their work ready position have a work ready spatial volume of between 41.42 ft.$^3$ (when arm swung all the way down) and 58.97 ft.$^3$ when arm swung all the way up), while the stowed position of the same prototypes have a minimum spatial volume of 20.51 ft.$^3$ Furthermore, the process involved in reconfiguring the personnel basket from the work ready position to the much more compact stowed positions is relatively quick and straightforward. In order to move from the work ready position to the stowed position, one need only perform the following steps (not necessarily in this order): 1) remove the removable hand rail located above the collapsible side panel; 2) detach the lock down plate so that the doors of the door panel can be opened inwardly; 3) raise the floor upwards to a vertical position where it is parallel to the front panel; 4) collapse the collapsible panel at is center by swinging the folding panels inwardly; 5) collapse the door panel by swinging the two doors inwardly; and 6) pushing the front panel and the back panel towards each other so that the entire personnel basket is collapsed inwardly in accordion-like fashion. These easy steps for reconfiguring the personnel basket from the work ready position to the stowed position make its stowage very quick and easy.

In addition to the ability to conserve space by collapsing the personnel basket into a significantly smaller volume in the stowed position, the corresponding ease and facility with which the personnel basket can be detachably mounted on and used with a crane boom is of great importance. Use of the quick attach yoke and the corresponding basket adapter allows for the personnel basket to be manually attached or manually detached from a crane boom in a very short period of time. For example, the personnel basket can be manually reconfigured from a stowed position to a work ready position and attached to the end if a crane boom and ready for use in approximately 2-3 minutes from start to finish when the quick attach yoke is already attached to the personnel basket and the basket adapter is already attached to the end of a crane boom.

It should also be noted that the personnel basket does not have to be removed from the boom of a crane in order to place it into its stowed position or in order to switch the personnel basket from the stowed position back to its work ready position. In fact, the personnel basket can remain attached to the end of a crane boom in either position and during reconfiguration from one position to the other. The personnel basket in the stowed position may be left attached to the end of a crane boom and simply lowered while still attached onto the back of a service truck or other mobile vehicle for transport. However, in practice it may sometimes be advisable for transport of the crane and personnel basket to and from remote job sites to remove the personnel basket from the boom of a crane when it is intended to stow the personnel basket for transport.

Additionally, the inventors are cognizant of the fact that inward-slanting hand rails are required by the Occupational Safety and Health Administration (OSHA). Thus, the hand rails located above the front panel, the back panel, and the collapsible side panel will each be mounted so that they are tilted inwardly from the top edges of the respective panels. This is illustrated in the accompanying drawing figures.

Additional features of the invention are illustrated in the accompanying drawings. The inventors reserve the right to later describe and claim all such features whether or not they have been specifically pointed-out and discussed in this brief written description.

Furthermore, although the inventive concepts hereby disclosed have been described with reference to specific embodiments, it should be understood that the above-described specific embodiments are not intended to limit the scope of the in concepts hereby disclosed, but merely to illustrate some of the specific embodiments of the personnel basket. It should be understood that various modifications of the disclosed embodiments, as well as alternative embodiments of the inventive concepts, will be apparent to persons skilled in the art upon reference to the description of the embodiments and drawings that are provided or upon reference to the appended claims.

What we claim is:

1. A personnel basket that provides a partially enclosed work platform that is configured to be suspended from an end of a crane boom at a desired angle in relation to the crane boom, the personnel basket being comprised of:

An adapter mount for detachably connecting the personnel basket to the end of a crane's boom so that the personnel basket is suspended therefrom;

A basket yoke with a top end that is rigidly attached to the adapter mount and extends perpendicularly downward therefrom;

Four walls and a floor that cooperate to form the partially enclosed work platform, A support structure for connecting at least one of the walls to the basket yoke wherein the support structure is rotatably connected to a bottom end of the basket yoke and rotatably connected to a locking plate at a separate position on the support structure;

An index plate with an articulation opening wherein the index plate is rigidly attached to the basket yoke and is further connected to the locking plate by means of a locking handle such that the locking handle passes through and is slidable within the articulation opening and configured to be selectively locked or unlocked in place at varying positions within the articulation opening so as to adjust an angle between the partially enclosed work platform and the basket yoke, thereby allowing the partially enclosed work platform to be selectively maintained at the desired angle in relation to the attached crane boom by means of selectively unlocking and locking the locking handle at a desired position of the varying positions within the articulation opening of the index plate.

2. The personnel basket of claim 1 wherein:

The four walls that are vertical panels comprised of:

A front panel;

A back panel;

A door panel containing at least one door configured to be opened for ingress into or egress from the workspace;

A side panel;

The floor is a horizontal rectangular plate wherein the floor is rigidly connected to and supported by at least one support arm and said at least one support arm is connected to a bottom edge of at least one of the four walls.

3. The personnel basket of claim 2 wherein:

the door panel is comprised of a first door that is hingedly connected to the front panel and further comprised of a second door that is hingedly connected to the back panel such that the doors configured to be swung into a closed position or opened until they are parallel with the front panel and back panel;

the side panel is collapsible and is comprised of a first folding panel that is hingedly connected to the front panel and a second folding panel that is hingedly connected to the back panel, and wherein the first folding panel and second folding panel are further hingedly connected to each other at the center of the side panel by a central hinge;

the at least one support arm supporting the floor is pivotably connected to the bottom edge of the front panel and may selectively be pivoted from a horizontal position upwards until it is parallel with the front panel;

such that the personnel basket configured to be selectively maintained in a work ready position providing the partially enclosed work platform, or configured to be collapsed from the work ready position and folded into a stowed position by pivoting the floor upwards so that it is parallel with the front panel, opening both doors inwardly until they are parallel with the front panel and back panel, folding both of the folding panels inwardly until they are parallel with the front panel and back panel, and applying compressive force to the front panel and the back panel so that they are pushed toward each other, thereby collapsing the entire personnel basket inwardly into the stowed position that occupies a reduced spatial volume.

4. The personnel basket of claim 3 further including:

means for locking the doors of the door panel in place when the personnel basket is in the work ready position and the doors are closed;

and two kick plates located immediately below the doors that provide additional support to the door panel and help prevent tools or parts from falling out of the personnel basket, wherein one of the kick plates is hingedly connected to the front panel and the other kick plate is hingedly connected to the back panel and the kick plates are also hingedly connected to each other at the center of the door panel so that they are configured to be folded inwardly when the personnel basket is collapsed into the stowed position.

5. The personnel basket of claim 4 further including:

A rigid side hand rail configured to be detachably connected on one of its ends to the top edge of the front panel and detachably connected at its other end to the top edge of the back panel and that is connected and positioned parallel and above the top edge of the side panel when the personnel basket is in a work ready position, but wherein the rigid hand rail when connected to the front panel and back panel is offset inwardly from the top edge of the side panel, wherein the side hand rail configured to be disconnected from the front panel and back panel when the personnel basket is to be reconfigured into its stowed position.

6. The personnel basket of claim 5 further including:

lips extending inwardly from the bottom edges of the first folding panel and second folding panel and underlying the floor when the personnel basket is in its work ready position;

lips extending inwardly from the two kick plates and underlying the floor when the personnel basket is in its work ready position.

7. The personnel basket of claim 6 further including:

A rigid back hand rail that is rigidly connected to the top edge of the back panel and positioned parallel and above the top edge of the back panel, but wherein the back hand rail is offset inwardly from the top edge of the back panel;

A rigid front hand rail that is rigidly connected to the top edge of the front panel and positioned parallel and above the top edge of the front panel, but wherein the front hand rail is offset inwardly from the top edge of the front panel.

8. The personnel basket of claim 7 further including means for maintaining the personnel basket in a stowed position when it is desired to maintain it in the stowed position for storage or transport purposes.

9. The personnel basket of claim 8 further including a case for storing manuals and a tool box for storing tools.

10. The personnel basket of claim 1 further including:

a quick attach yoke that is comprised of a U-channel receiver on one of its ends and two bolt holes at its opposite end and wherein the quick attach yoke is detachably connected to the adapter mount;

and a basket adapter configured to be detachably connected to the end of a crane boom wherein the basket adapter is comprised of an adapter jaw and an adapter bolt.

11. A personnel basket configured to be suspended from an end of a crane boom at a desired angle in relation to the boom and is comprised of:

A basket adapter configured to be detachably connected to the end of the crane boom and is comprised of an adapter jaw and an adapter bolt;

A quick attach yoke that is comprised of a U-channel receiver and two bolt holes such that the adapter jaw configured to be engaged with the U-channel receiver and the adapter bolt configured to be slid through the two bolt holes and pinned in place in order to connect the personnel basket to the crane boom;

An adapter mount that is rigidly attached to the quick attach yoke;

A basket yoke that is rigidly attached to the adapter mount;

A vertical support beam that is rotatably connected by means of a yoke pin to the basket yoke;

A front panel rigidly attached to the vertical support beam;

A side panel comprised of a first folding panel and a second folding panel hingedly connected to each other at the vertical center of the side panel by a central hinge, and with the first folding panel being hingedly connected on one of its edges to the front panel by means of piano hinges;

A back panel that is hingedly connected on one of its edges to the second folding panel by means of piano hinges;

A door panel comprised of a first door and a second door, the first door being hingedly connected on one of its edges to the back panel by means of piano hinges and the second door being hingedly connected to the front panel by mean of piano hinges;

A floor plate rigidly connected to and supported by at least one support arm wherein the support arm is also pivotably connected to an edge of the front panel;

A locking plate that is rotatably connected to the vertical support beam by means of a beam pin connection;

An index plate with an arced articulation opening through the index plate wherein the index plate is rigidly attached to the basket yoke and is further slidably connected to the locking plate by means of a locking handle such that the locking handle passes through the locking plate and also passes through and is slidable within the articulation opening of the index plate and configured to be selectively locked or unlocked in place at varying positions within an arced articulation opening so as to adjust and maintain the angle between the vertical support beam and the basket yoke;

Wherein the front panel, side panel, back panel, door panel, and floor cooperate to provide a partially enclosed work platform when the personnel basket is in a work ready position, or selectively configured to be collapsed from that work ready position and folded inwardly into a stowed position by pivoting the floor upwards so that it is parallel with the front panel, opening both doors inwardly until they are parallel with the front panel and back panel, folding both of the folding panels inwardly until they are parallel with the front panel and back panel, and applying compressive force to the front panel and the back panel so that they are pushed toward each other, thereby collapsing the entire personnel basket inwardly into the stowed position that occupies a reduced spatial volume;

Wherein the personnel basket configured to be attached to or detached from the end of the crane boom by means of the detachable connections provided by the basket adapter and quick attach yoke.

* * * * *